US010598396B2

(12) United States Patent
Seo et al.

(10) Patent No.: US 10,598,396 B2
(45) Date of Patent: Mar. 24, 2020

(54) FLOATING-TYPE HUMIDIFIER CONTAINER

(71) Applicant: MIRO CO. LTD., Incheon (KR)

(72) Inventors: Dong Jin Seo, Incheon (KR); Yong Ju Oh, Incheon (KR); Min Seok Kim, Incheon (KR)

(73) Assignee: MIRO CO. LTD., Incheon (KR)

( * ) Notice: Subject to any disclaimer, the term of this patent is extended or adjusted under 35 U.S.C. 154(b) by 250 days.

(21) Appl. No.: 15/743,160

(22) PCT Filed: Jul. 11, 2016

(86) PCT No.: PCT/KR2016/007533

§ 371 (c)(1),
(2) Date: Jan. 9, 2018

(87) PCT Pub. No.: WO2017/007293

PCT Pub. Date: Jan. 12, 2017

(65) Prior Publication Data

US 2018/0202672 A1 Jul. 19, 2018

(30) Foreign Application Priority Data

Jul. 9, 2015 (KR) ..... 10-2015-0097879
Oct. 26, 2015 (KR) ..... 10-2015-0149027
Jul. 11, 2016 (KR) ..... 10-2016-0087479

(51) Int. Cl.
*F24F 6/00* (2006.01)
*F24F 6/04* (2006.01)
(Continued)

(52) U.S. Cl.
CPC ..... *F24F 6/043* (2013.01); *F24F 6/00* (2013.01); *F24F 6/02* (2013.01); *F24F 6/12* (2013.01);
(Continued)

(58) Field of Classification Search
CPC ..... F24F 6/00; F24F 2006/008
(Continued)

(56) References Cited

U.S. PATENT DOCUMENTS 6,592,107 B1 7/2003 Wong

FOREIGN PATENT DOCUMENTS

CN 101975444 A 2/2011
CN 204227624 U 3/2015
(Continued)

*Primary Examiner* — Robert A Hopkins
(74) *Attorney, Agent, or Firm* — Novick, Kim & Lee, PLLC; Sang Ho Lee

(57) ABSTRACT

A floating-type humidifier container according to an exemplary embodiment of the present invention includes: a lower body having a space portion which is opened at an upper side thereof and accommodates water therein so that a floating-type humidifier floats on the water; and an upper body having an opening portion provided in an upper portion of the upper body so that one end of the floating-type humidifier is penetratively inserted into the opening portion, in which the upper body includes an inclined portion which is formed to be inclined downward toward a center of the space portion so that humidification particles discharged from the floating-type humidifier are introduced into the space portion through the opening portion.

13 Claims, 7 Drawing Sheets

(51) Int. Cl.
*F24F 6/12* (2006.01)
*F24F 13/20* (2006.01)
*F24F 6/02* (2006.01)

(52) U.S. Cl.
CPC ..... *F24F 13/20* (2013.01); *F24F 2006/008* (2013.01)

(58) Field of Classification Search
USPC ..... 261/78.2
See application file for complete search history.

(56) References Cited

FOREIGN PATENT DOCUMENTS

| | | | | |
|---|---|---|---|---|
| CN | 205860329 | U | * | 1/2017 |
| JP | 8-42903 | A | | 2/1996 |
| JP | 08-075196 | A | | 3/1996 |
| JP | 3011621 | B2 | | 2/2000 |
| JP | 2000-245680 | A | | 9/2000 |
| KR | 10-2001-0090320 | A | | 10/2001 |
| KR | 20-0350220 | Y1 | | 5/2004 |
| KR | 10-1268866 | B1 | | 5/2013 |
| KR | 10-1374967 | B1 | | 3/2014 |
| KR | 10-1528290 | B1 | | 6/2015 |
| KR | 10-2015-0075489 | A | | 7/2015 |

* cited by examiner

FLOATING-TYPE HUMIDIFIER CONTAINER

TECHNICAL FIELD

Exemplary embodiments of the present invention relate to a floating-type humidifier container, and more particularly, to a floating-type humidifier container including an upper body configured to prevent water from overflowing or splattering, and a lower body configured to accommodate therein water.

BACKGROUND ART

In general, a humidifier refers to a device which artificially maintains desired humidity in a dry room. That is, the humidifier refers to a device which converts water into particles or moisture vapor by using electric power and sprays the particles or the moisture vapor into the room.

The humidifiers are classified, based on a humidification method, into an ultrasonic humidifier which uses an ultrasonic vibrator, a heating-type humidifier which heats water with a heater or an electrode bar and sprays vapor, and a complex-type humidifier which has a combination of advantages of the ultrasonic humidifier and the heating-type humidifier.

By the way, recently, among the aforementioned humidifies, a floating-type humidifier, which is conveniently cleaned and managed, is widely used.

However, the floating-type humidifier is used in a state in which the floating-type humidifier floats on the water, and as a result, the floating-type humidifier is vulnerable to external vibration and often sways in comparison with the existing humidifiers. For this reason, water droplets, which are produced in the floating-type humidifier, move vertically upward and then fall onto a water surface in the floating-type humidifier, which increases water noise and causes water droplets to splatter to the outside.

Therefore, there is a need for development on a humidifier container capable of protecting a humidifier from overflowing or splattering water caused by external impact, and reusing humidification particles discharged from the humidifier.

As literature in the related art, there is Korean Patent Application Laid-Open No. 10-2001-0090320 (entitled "Humidifier Using External Water Source", published on Oct. 18, 2001).

DISCLOSURE

Technical Problem

An exemplary embodiment of the present invention provides a floating-type humidifier container, in which an upper surface of an upper body is inclined downward, such that humidification particles, which are discharged from a floating-type humidifier and dropped in a humidifier direction, are introduced back into a lower body.

Technical Solution

A floating-type humidifier container according to an exemplary embodiment of the present invention includes: a lower body having a space portion which is opened at an upper side thereof and accommodates water therein so that a floating-type humidifier floats on the water; and an upper body having an opening portion provided in an upper portion of the upper body so that one end of the floating-type humidifier is penetratively inserted into the opening portion, in which the upper body includes an inclined portion which is formed to be inclined downward toward a center of the space portion so that humidification particles discharged from the floating-type humidifier are introduced into the space portion through the opening portion.

The inclined portion may include an inflow portion which is formed as a circumferential surface of the opening portion and the floating-type humidifier are spaced apart from each other, such that the humidification particles are introduced into the space portion through the opening portion.

The inflow portion may be formed by at least one protruding portion which protrudes to have a predetermined size along an end of the inclined portion.

The protruding portion may protrude from the end of the inclined portion toward a center of the opening portion in a horizontal direction.

The protruding portion may protrude from the end of the inclined portion so as to be inclined downward.

The inflow portion may be formed by at least one recessed groove portion which is recessed to have a predetermined size along an end of the inclined portion.

The inclined portion may have a spiral groove portion or a spiral protrusion portion which is spirally formed on an upper surface of the inclined portion.

The lower body further may include: a coupling groove portion which is formed in an upper portion of the lower body in a circumferential direction and comes into contact with an inner circumferential surface of a lower portion of the upper body; and a seating portion which extends outward from the coupling groove portion and on which the lower portion of the upper body is seated.

The upper body may have a through portion which is formed at a position corresponding to the coupling groove portion and formed to have a predetermined size so that a power cable connected to the floating-type humidifier penetrates the through portion.

A height of the through portion may be greater than a height of the coupling groove portion.

A height of the through portion may be equal to a height of the coupling groove portion, and the lower body may have a fixing groove portion which is formed at an end of the coupling groove portion and fixes the power cable.

The floating-type humidifier container according to the exemplary embodiment of the present invention may further include a support unit which is disposed at a lower side of the lower body so as to fix the lower body.

The support unit may have a groove which is concavely formed in an upper surface of the support unit so as to correspond to a shape of a lower portion of the lower body.

Other detailed matters of the exemplary embodiment are included in the detailed description and the accompanying drawings.

Advantageous Effects

According to the exemplary embodiment of the present invention, the upper surface of the upper body is inclined downward in a direction toward a center of an interior of the humidifier, such that the humidification particles, which are discharged from the floating-type humidifier and dropped in a humidifier direction, are introduced into the lower body, and as a result, it is possible to minimize a decrease in amount of water in a water tank.

According to the exemplary embodiment of the present invention, it is possible to improve an environment in which the humidifier is used, by preventing water from splattering to the outside when the humidification particles, which are discharged from the floating-type humidifier and settled on the upper surface of the upper body, are dropped onto a surface of water accommodated in the lower body.

According to the exemplary embodiment of the present invention, the spiral passageway is provided on the upper surface of the upper body, such that a speed at which the humidification particles flow into the lower body is minimized, and as a result, it is possible to more effectively inhibit noise generated when the humidification particles are dropped onto the surface of the water.

According to the exemplary embodiment of the present invention, since the inflow portion is formed, it is possible to ensure a path through the humidification particles are introduced back into the lower body even though a large amount of water is accommodated in the floating-type humidifier.

BEST MODE

Figure 1:
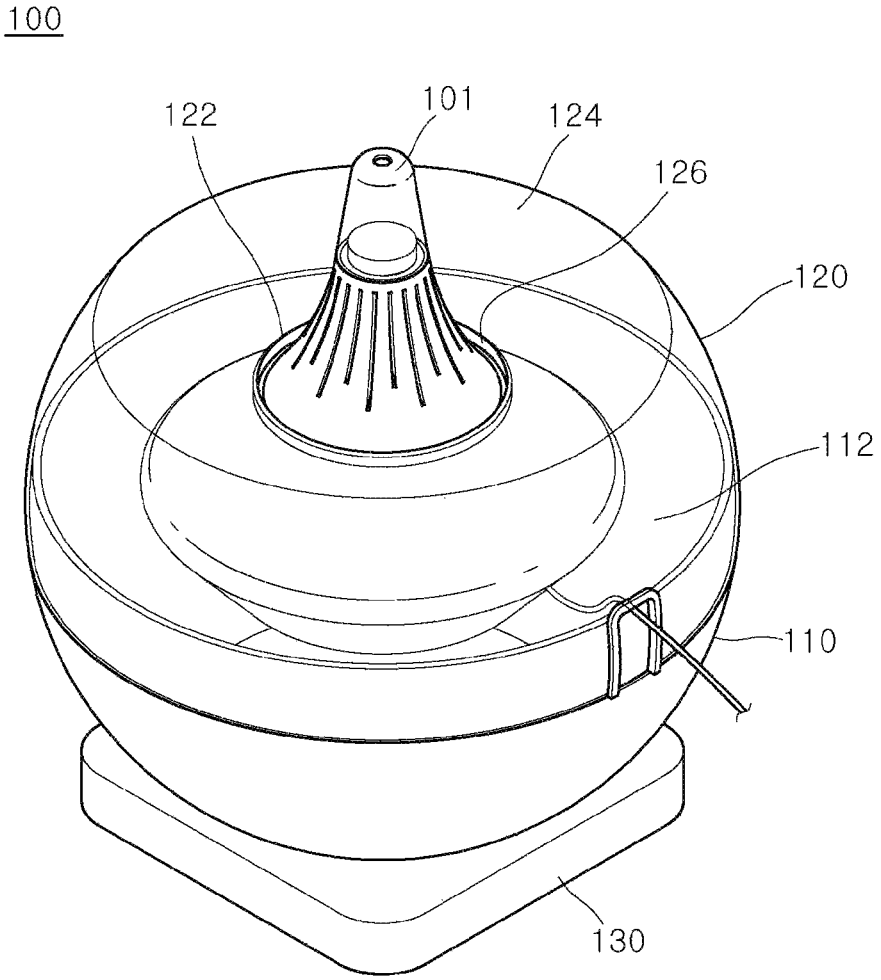
FIG. 1 is a perspective view for explaining a floating-type humidifier container according to an exemplary embodiment of the present invention.

Advantages and/or features of the present invention and methods of achieving the advantages and features will be clear with reference to exemplary embodiments described in detail below together with the accompanying drawings. However, the present invention is not limited to exemplary embodiment disclosed herein but will be implemented in various forms. The exemplary embodiments are provided so that the present invention is completely disclosed, and a person of ordinary skilled in the art can fully understand the scope of the present invention. Therefore, the present invention will be defined only by the scope of the appended claims. Like reference numerals indicate like constituent elements throughout the specification.

Hereinafter, exemplary embodiments of the present invention will be described in detail with reference to the accompanying drawings.

Figure 2:
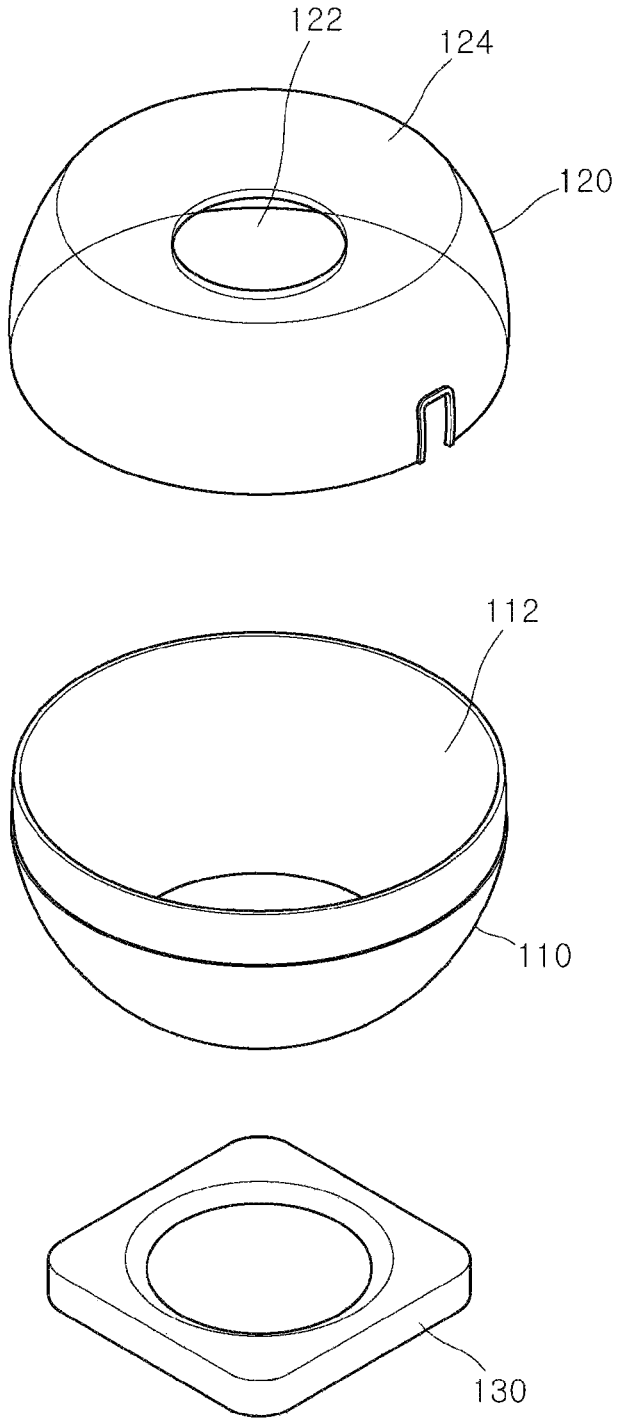
FIG. 2 is an exploded perspective view for explaining the floating-type humidifier container according to the exemplary embodiment of the present invention.

FIG. 1 is a perspective view for explaining a floating-type humidifier container according to an exemplary embodiment of the present invention, and FIG. 2 is an exploded perspective view for explaining the floating-type humidifier container according to the exemplary embodiment of the present invention.

Referring to FIGS. 1 and 2, a floating-type humidifier container 100 according to an exemplary embodiment of the present invention includes a lower body 110 and an upper body 120.

The lower body 110 has a space portion 112 which is opened at an upper side thereof and accommodates water therein so that a floating-type humidifier 101 floats on the water.

In this case, the space portion 112 may be formed to have a width that gradually decreases toward a lower portion of the space portion 112 so as to correspond to a shape of the lower body 110. In other words, the space portion 112 may be defined as a space formed as an interior of the lower body 110 is concavely recessed.

For reference, the water accommodated in the space portion 112 may be used to float the floating-type humidifier 101 and produce humidification particles.

As illustrated in the drawings, the lower body 110 may be formed to have a width that gradually decreases toward a lower portion of the lower body 110.

That is, the lower body 110 may be formed in a cylindrical shape such that a lateral surface of the lower body 110 is inclined downward toward a center of the lower body 110, but the present invention is not limited thereto, and the lower body 110 may have various shapes. For example, the lower body 110 may be formed in the form of a hexahedron having a quadrangular cross section.

The lower body 110 may be made of a material such as metal, plastic, and synthetic resin, but various materials, for example, materials such as glass and aluminum may be selectively used, as necessary, so that the lower body 110 may accommodate the water.

In particular, the lower body 110 may be made of a transparent or semi-transparent material so that the amount of water accommodated in the lower body 110 may be checked with the naked eye.

Meanwhile, in the present exemplary embodiment, the floating-type humidifier container 100 may further include a support unit 130 which is disposed at a lower side of the lower body 110 so as to fix the lower body 110.

The support unit 130 may have a groove which is concavely formed in an upper surface of the support unit 130 so as to correspond to a shape of the lower portion of the lower body 110. Therefore, it is possible to minimize swaying of the lower body 110 caused by external impact.

As an modified example of the support unit 130, in a case in which multiple protruding portions (not illustrated) are provided on the lower portion of the lower body 110, the support unit 130 may have depressed portions (not illustrated) which are formed on the upper surface of the support unit 130 so as to correspond to the protruding portions.

For this reason, the lower body 110 may be more stably seated and fixed onto the support unit 130.

Here, as illustrated in the drawings, the support unit 130 may be formed in the form of a hexahedron having curved corners, but the present invention is not limited thereto, and the support unit 130 may have various shapes such as a cylindrical shape.

A lower portion of the upper body 120 is coupled to an upper portion of the lower body 110. To this end, the lower portion of the upper body 120 may be opened, and the upper body 120 and the lower body 110 may be coupled to each other as a rim of the opened lower portion of the upper body 120 comes into direct contact with the opened upper portion of the lower body 110.

A structure for coupling the upper body 120 and the lower body 110 will be described in detail below with reference to FIG. 7.

As illustrated in the drawings, the upper body 120 may be formed to have a width that gradually decreases toward the lower portion of the upper body 120. That is, the upper body 120 may be formed to have a lateral surface inclined downward toward the outside of the upper body 120.

Therefore, in the present exemplary embodiment, an overall shape of the floating-type humidifier container 100 in which the upper body 120 and the lower body 110 are coupled to each other may be a jar shape of which the lateral edge is bent outward.

That is, in the floating-type humidifier container 100, a rim portion where the upper body 120 and the lower body 110 are coupled to each other may have a curved surface which is most convexly curved. For reference, the floating-type humidifier container 100 may have various shapes, for example, a polygonal column shape or a polyhedral shape, so that the floating-type humidifier container 100 may accommodate water therein.

The upper body 120 has an opening portion 122 formed in the upper portion of the upper body 120 so that one end of the floating-type humidifier 101 may be penetratively inserted into the opening portion 122.

The opening portion 122 may be formed at a position spaced apart inward from an outer circumference of the upper body 120 so as to have a circular shape or an elliptical shape having a width smaller than a width of the outer circumference. For reference, the opening portion 122 may have various shapes, for example, a triangular or quadrangular shape in accordance with an external shape of the floating-type humidifier 101.

The upper body 120 may include an inclined portion 124 which is inclined downward toward the center of the space portion 112 such that the humidification particles discharged from the floating-type humidifier 101 are introduced into the space portion 112 through the opening portion 122.

The inclined portion 124 may be formed as an upper surface of the upper body 120 is inclined in a direction in which the opening portion 122 is formed.

In this case, an inflow portion 126 may be provided at an end portion of the inclined portion 124 such that the humidification particles discharged from the floating-type humidifier 101 are introduced back into the space portion 112.

In a case in which the water accommodated in the space portion 112 fully fills the space portion 112 up to a horizontal axis of the opening portion 122, the inflow portion 126 may provide a vacant space so that the floating-type humidifier 101 and the opening portion 122 are spaced apart from each other.

Therefore, since the inflow portion 126 is formed, it is possible to ensure a path through which the humidification particles are introduced back into the lower body 110 even though a large amount of water is accommodated in the floating-type humidifier 101.

In this case, the inflow portion 126 may be formed as a circumferential surface of the opening portion 122 and the floating-type humidifier 101 are spaced apart from each other. Therefore, the inflow portion 126 may allow the humidification particles to flow into the space portion 112 through the opening portion 122.

Hereinafter, various exemplary embodiments of the inflow portion 126 will be described in detail with reference to FIGS. 3 to 5. For reference, FIG. 3 is a perspective view for explaining an inflow part formed by an exemplary embodiment of a protruding portion according to the present invention, FIG. 4 is a perspective view for explaining an inflow part formed by another exemplary embodiment of the protruding portion according to the present invention, and FIG. 5 is a perspective view for explaining an inflow part formed by a recessed groove portion according to the present invention.

Figure 3:
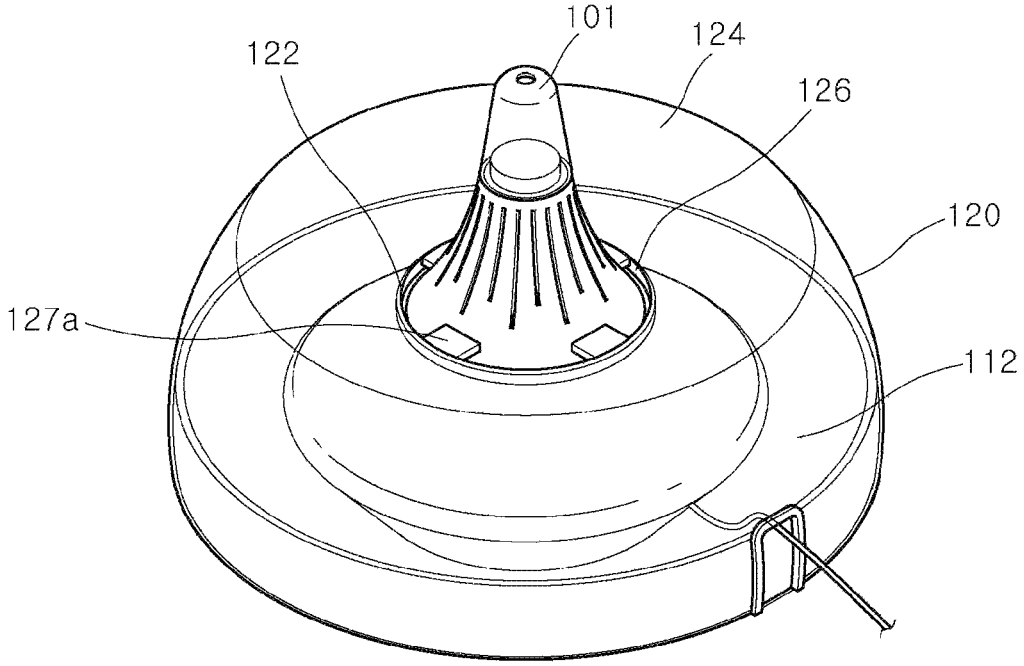
FIG. 3 is a perspective view for explaining an inflow part formed by an exemplary embodiment of a protruding portion according to the present invention.
Figure 4:
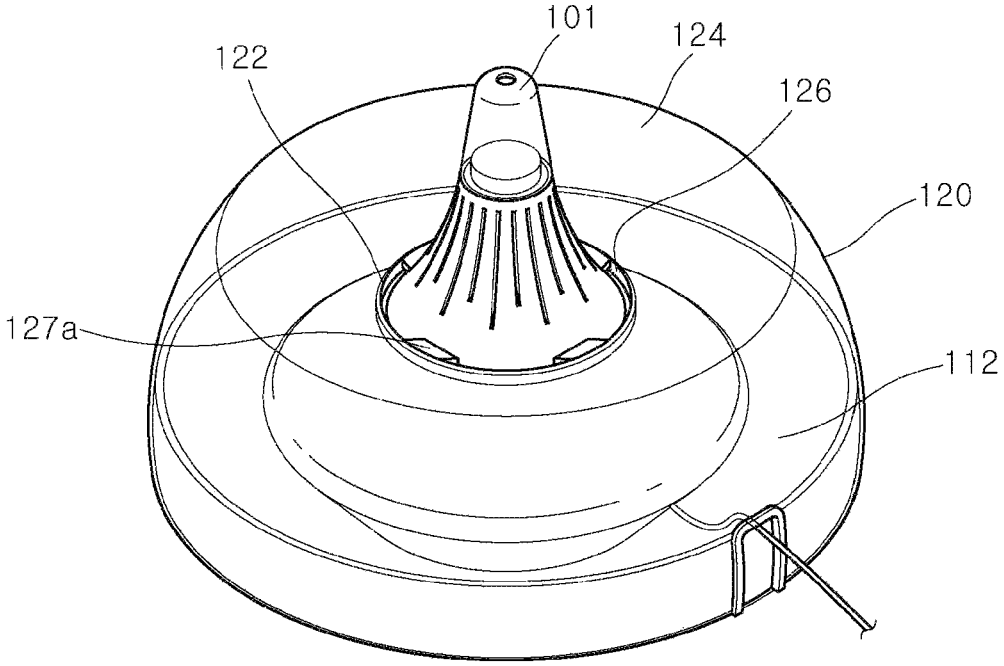
FIG. 4 is a perspective view for explaining an inflow part formed by another exemplary embodiment of the protruding portion according to the present invention.
Figure 5:
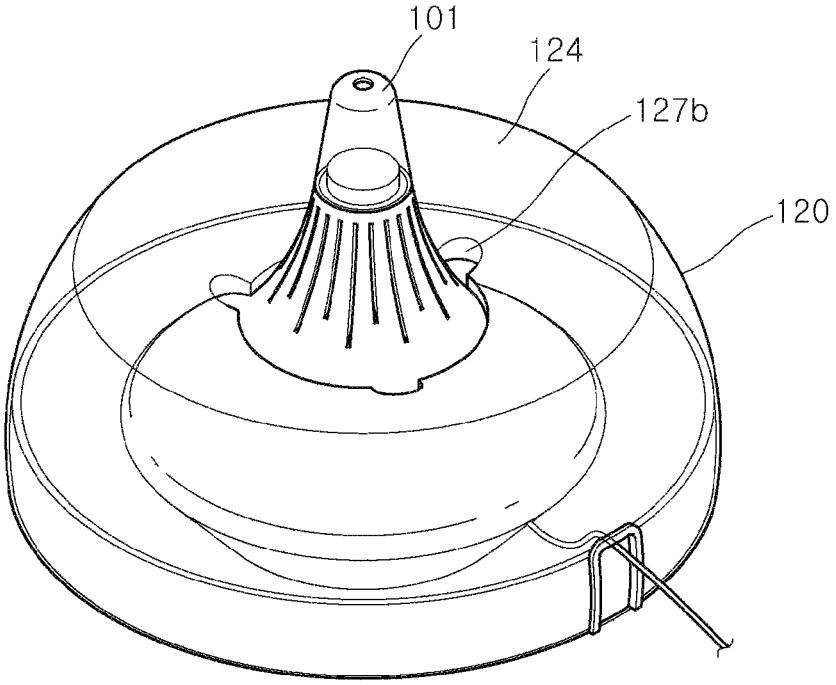
FIG. 5 is a perspective view for explaining an inflow part formed by a recessed groove portion according to the present invention.

First, referring to FIGS. 3 and 4, the inflow portion 126 may be formed by at least one protruding portion 127*a* which protrudes to have a predetermined size along an end of the inclined portion 124.

That is, the inflow portion 126 may be defined as a vacant space between a portion where the protruding portion 127*a* is not formed and the floating-type humidifier 101 at the end of the inclined portion 124.

In this case, as illustrated in FIG. 3, the protruding portion 127*a* may protrude from the end of the inclined portion 124 toward the center of the opening portion 122 in a horizontal direction.

As such, the humidification particles may be introduced back into the space portion 112 under an environment in which the floating-type humidifier 101 may stably float.

In addition, as illustrated in FIG. 4, the protruding portion 127*a* may protrude from the end of the inclined portion 124 so as to be inclined downward.

For reference, in the present exemplary embodiment, the protruding portion 127*a* protrudes from the end of the inclined portion 124 toward the space portion 112 in a vertical direction, but the present invention is not limited thereto, and the protruding portion 127*a* may protrude from the end of the inclined portion 124 in any one direction between the horizontal direction and the vertical direction.

For example, the protruding portion 127*a* may rectilinearly protrude from the end of the inclined portion 124.

Therefore, according to the present exemplary embodiment, it is possible to ensure a wide space of the inflow portion 126 which is the vacant space between the portion where the protruding portion 127*a* is not formed and the floating-type humidifier 101, and as a result, it is possible to introduce a large amount of humidification particles back into the space portion 112.

Next, referring to FIG. 5, the inflow portion 126 may be formed by at least one recessed groove portion 127*b* which is recessed to have a predetermined size along the end of the inclined portion 124.

Here, the recessed groove portion 127*b* may be depressed toward one end of the inclined portion 124 from at least one portion of a circumference defined by the end of the inclined portion 124.

For reference, in the present exemplary embodiment, it is assumed that the floating-type humidifier 101 is in contact with the end of the inclined portion 124.

For this reason, the inflow portion 126 may be defined as a vacant space between a bent portion of the recessed groove portion 127*b* and the floating-type humidifier 101.

Therefore, according to the present exemplary embodiment, the humidification particles may be collected in the space portion 112 in a state in which the floating-type humidifier 101 is fixed to the opening portion 122.

Meanwhile, the inclined portion 124 may be provided with a means for guiding the humidification particles so that the humidification particles may move downward along a circumference of the upper surface of the inclined portion 124.

Figure 6:
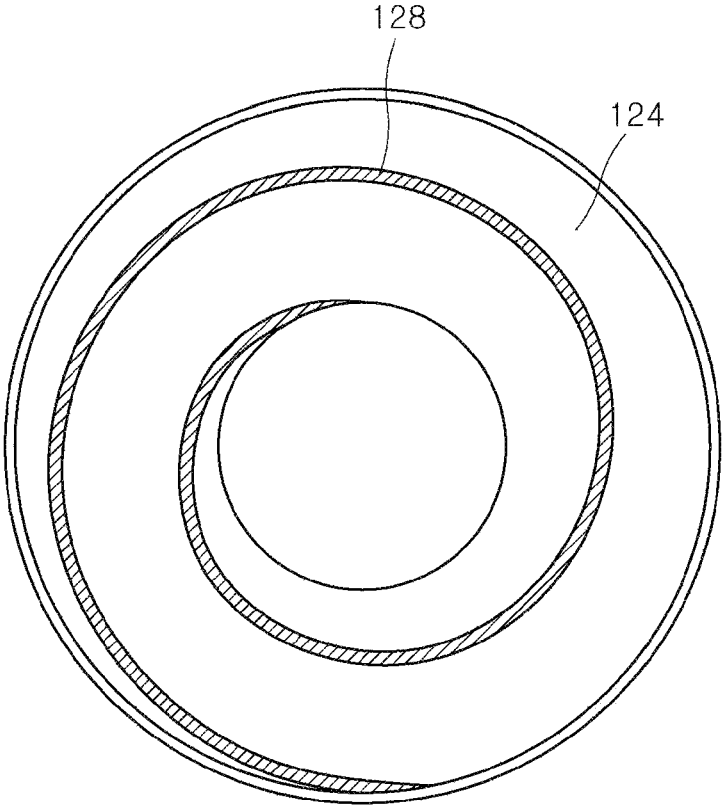
FIG. 6 is a top plan view for explaining a spiral groove portion provided in an inclined portion according to the present invention.

That is, as illustrated in FIG. 6, the inclined portion 124 may be provided with a spiral groove portion 128 spirally formed in the upper surface of the inclined portion 124. For reference, FIG. 6 is a top plan view for explaining the spiral groove portion provided in the inclined portion according to the present invention.

The spiral groove portion 128 is a passageway which guides the humidification particles into the floating-type humidifier (see "101" in FIG. 1), and because of the spiral shape, the humidification particles may move downward at a low speed and flow into the space portion (see "112" in FIG. 1). For reference, in the present exemplary embodiment, the inclined portion 124 is provided with the spiral groove portion 128 as a means for guiding the humidification particles, but the present invention is not limited thereto, and various passageway means such as a spiral protrusion portion (not illustrated) may be provided.

Therefore, it is possible to minimize noise generated when the humidification particles discharged from the floating-type humidifier (see "101" in FIG. 1) are dropped onto the water surface in the space portion 112.

Figure 7:
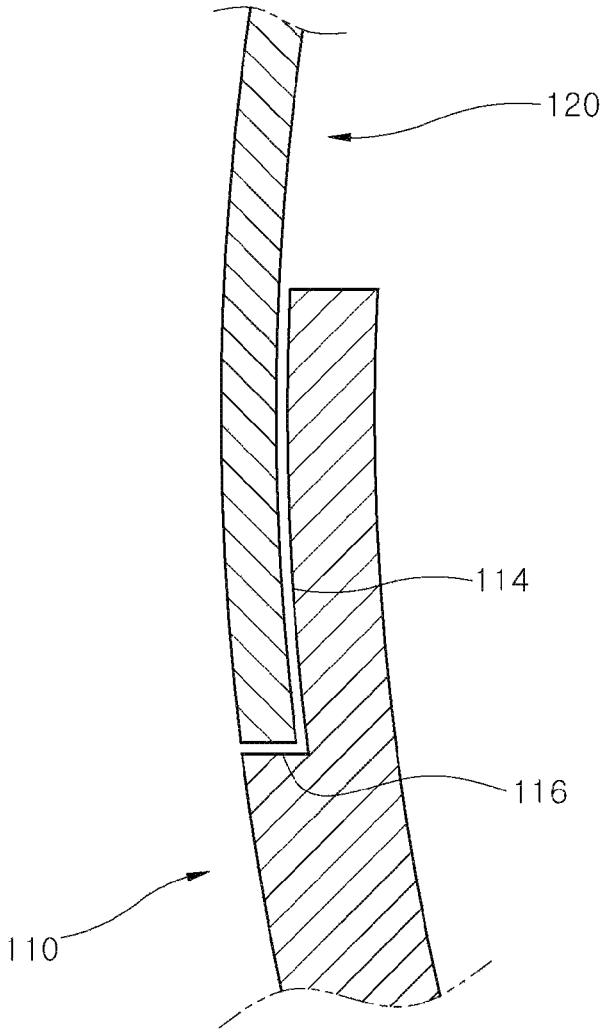
FIG. 7 is a top plan view for explaining a structure for coupling an upper body and a lower body according to the present invention.
Figure 8:
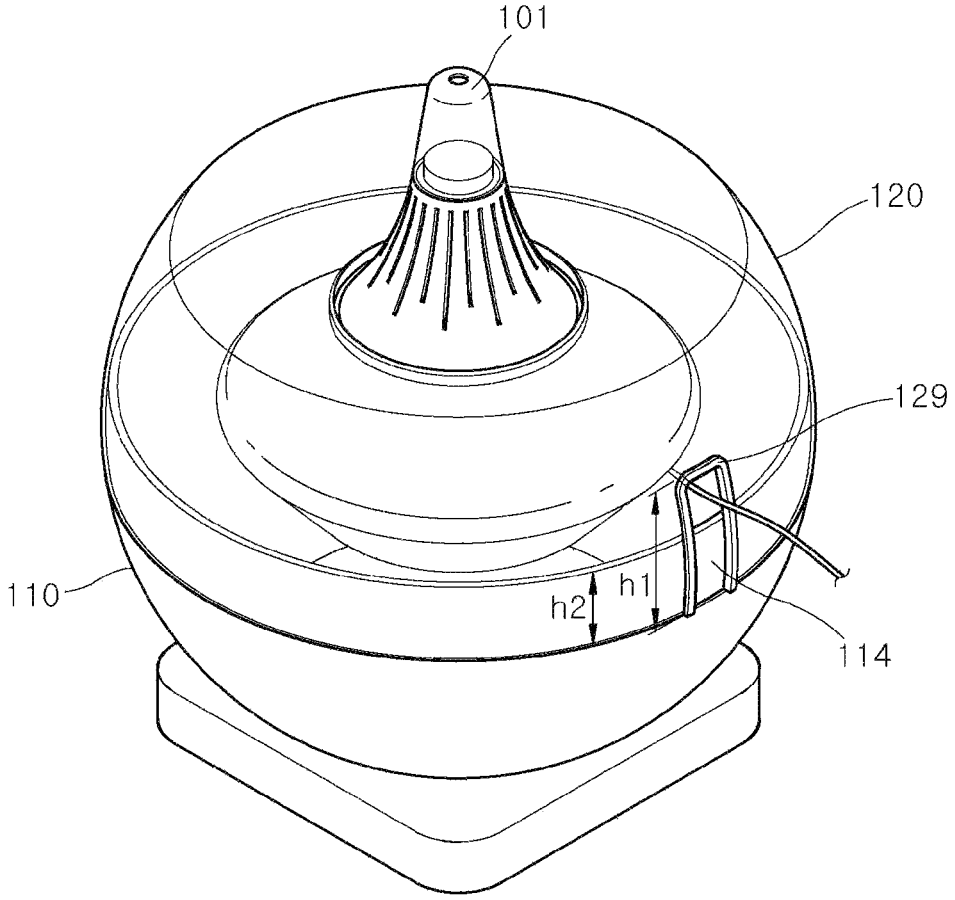
FIG. 8 is a perspective view for explaining an exemplary embodiment of a through portion according to the present invention.
Figure 9:
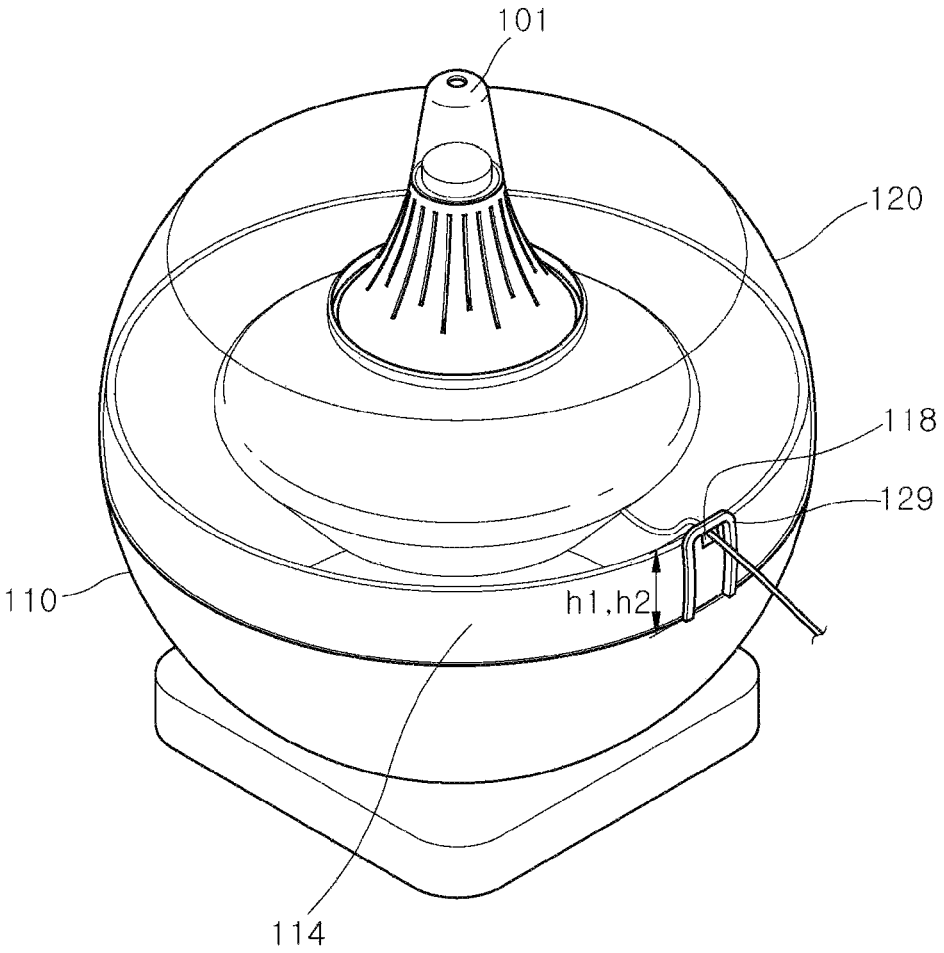
FIG. 9 is a perspective view for explaining another exemplary embodiment of the through portion according to the present invention.

FIG. 7 is a top plan view for explaining the structure for coupling the upper body and the lower body according to the present invention, FIG. 8 is a perspective view for explaining an exemplary embodiment of a through portion according to the present invention, and FIG. 9 is a perspective view for explaining another exemplary embodiment of the through portion according to the present invention.

First, as illustrated in FIG. 7, in the floating-type humidifier container (see "100" in FIG. 1), the upper body (see "120" in FIG. 1) and the lower body (see "110" in FIG. 1) may be coupled to each other as the lower portion of the upper body and the upper portion of the lower body are in direct contact with each other.

To this end, the lower body 110 may include a coupling groove portion 114 and a seating portion 116.

The coupling groove portion 114 may be formed in the upper portion of the lower body 110 in a circumferential direction.

Therefore, a circumferential surface of the coupling groove portion 114 may be in contact with an inner circumferential surface of the lower portion of the upper body 120.

The seating portion 116 may extend outward from the coupling groove portion 114.

Therefore, the lower portion of the upper body 120 may be seated on the seating portion 116. For reference, a length of the seating portion 116 may be equal to a thickness of a circumference of the lower portion of the upper body 120.

Therefore, the floating-type humidifier container 100 may be implemented in the form of a single three-dimensional figure as the lower portion of the upper body 120 is engaged with and coupled to the circumference of the upper portion of the lower body 110.

Next, referring to FIGS. 8 and 9, the upper body 120 may be provided with a through portion 129 formed in a groove shape recessed along the end of the lower portion of the upper body 120.

The through portion 129 may be formed at a position corresponding to the coupling groove portion 114.

For this reason, when the upper body 120 and the lower body 110 are coupled to each other, the through portion 129 may come into direct contact with any one portion of the circumference of the upper portion of the lower body 110 that defines the coupling groove portion 114.

The through portion 129 may have a predetermined size so that a power cable connected to the floating-type humidifier 101 penetrates the through portion 129. Here, the through portion 129 may be sized to minimize motion of the power cable.

Furthermore, the through portion 129 may be formed in a shape such as a circular shape or an elliptical shape corresponding to an external shape of the power cable, but the shape of the through portion 129 may vary in accordance with the shape of the power cable.

Meanwhile, the through portion 129 may be formed to correspond to a height h2 of the coupling groove portion 114.

As an example, as illustrated in FIG. 8, a height h1 of the through portion 129 may be greater than the height h2 of the coupling groove portion 114.

The reason is that the power cable penetrates a vacant space provided at an upper side of the coupling groove portion 114 because of a difference between the height h1 of the through portion 129 and the height h2 of the coupling groove portion 114.

As another example, as illustrated in FIG. 9, the height h1 of the through portion 129 may be equal to the height h2 of the coupling groove portion 114.

In this case, the lower body 110 may be provided with a fixing groove portion 118 formed at an end of the coupling groove portion 114.

Therefore, the power cable may be fixed by the fixing groove portion 118, and connected to the floating-type humidifier 101 while penetrating the fixing groove portion 118.

While the specific exemplary embodiments according to the present invention have been described above, the exemplary embodiments may be modified to various exemplary embodiments without departing from the scope of the present invention. Therefore, the scope of the present invention should not be limited to the described exemplary embodiments, and should be defined by not only the claims to be described below, but also those equivalent to the claims.

While the present invention has been described with reference to the limited exemplary embodiments and the drawings, the present invention is not limited to the exemplary embodiments, and may be variously modified and altered from the disclosure by those skilled in the art to which the present invention pertains. Therefore, the spirit of the present invention should be defined by the appended claims, and all of the equivalents or equivalent modifications of the claims belong to the scope of the spirit of the present invention.

The invention claimed is:

1. A floating-type humidifier container comprising:

a lower body having a space portion which is opened at an upper side thereof and accommodates water therein so that a floating-type humidifier floats on the water; and an upper body having an opening portion provided in an upper portion of the upper body so that one end of the floating-type humidifier is penetratively inserted into the opening portion, wherein the upper body includes an inclined portion which is formed to be inclined downward toward a center of the space portion so that humidification particles discharged from the floating-type humidifier are introduced into the space portion through the opening portion.

2. The floating-type humidifier container of claim 1, wherein the inclined portion includes an inflow portion which is formed as a circumferential surface of the opening portion and the floating-type humidifier are spaced apart from each other, such that the humidification particles are introduced into the space portion through the opening portion.

3. The floating-type humidifier container of claim 2, wherein the inflow portion is formed by at least one protruding portion which protrudes to have a predetermined size along an end of the inclined portion.

4. The floating-type humidifier container of claim 3, wherein the protruding portion protrudes from the end of the inclined portion toward a center of the opening portion in a horizontal direction.

5. The floating-type humidifier container of claim 3, wherein the protruding portion protrudes from the end of the inclined portion so as to be inclined downward.

6. The floating-type humidifier container of claim 2, wherein the inflow portion is formed by at least one recessed groove portion which is recessed to have a predetermined size along an end of the inclined portion.

7. The floating-type humidifier container of claim 1, wherein the inclined portion has a spiral groove portion or a spiral protrusion portion which is spirally formed on an upper surface of the inclined portion.

8. The floating-type humidifier container of claim 1, wherein the lower body further includes:

a coupling groove portion which is formed in an upper portion of the lower body in a circumferential direction and comes into contact with an inner circumferential surface of a lower portion of the upper body; and a seating portion which extends outward from the coupling groove portion and on which the lower portion of the upper body is seated.

9. The floating-type humidifier container of claim 8, wherein the upper body has a through portion which is formed at a position corresponding to the coupling groove portion and formed to have a predetermined size so that a power cable connected to the floating-type humidifier penetrates the through portion.

10. The floating-type humidifier container of claim 9, wherein a height of the through portion is greater than a height of the coupling groove portion.

11. The floating-type humidifier container of claim 9, wherein a height of the through portion is equal to a height of the coupling groove portion, and the lower body has a fixing groove portion which is formed at an end of the coupling groove portion and fixes the power cable.

12. The floating-type humidifier container of claim 1, further comprising:

a support unit which is disposed at a lower side of the lower body so as to fix the lower body.

13. The floating-type humidifier container of claim 12, wherein the support unit has a groove which is concavely formed in an upper surface of the support unit so as to correspond to a shape of a lower portion of the lower body.

* * * * *